United States Patent [19]

Hall et al.

[11] 4,362,513

[45] Dec. 7, 1982

[54] DUAL PIVOT OUTBOARD MOTOR WITH TRIM AND TILT TOGGLE LINKAGE

[75] Inventors: Charles B. Hall, Ingleside; Edward D. McBride, Waukegan, both of Ill.; Robert F. Young, Kenosha, Wis.

[73] Assignee: Outboard Marine Corporation, Waukegan, Ill.

[21] Appl. No.: 173,161

[22] Filed: Jul. 28, 1980

[51] Int. Cl.[3] ..... B63H 5/12

[52] U.S. Cl. ..... 440/61; 440/63

[58] Field of Search ..... 440/53, 55, 56, 57, 440/58, 59, 60, 61, 62, 63, 900

[56] References Cited

U.S. PATENT DOCUMENTS

| | | | |
|---|---|---|---|
| 172,945 | 2/1876 | Atkinson | 440/61 |
| 2,809,605 | 10/1957 | Russell | 440/61 |
| 3,145,003 | 8/1964 | Hart | 440/61 |
| 3,486,724 | 12/1969 | Adamski | 440/61 |
| 3,577,953 | 5/1971 | Braun | 440/61 |

FOREIGN PATENT DOCUMENTS

| | | | |
|---|---|---|---|
| 1552872 | 1/1969 | France | 440/61 |

*Primary Examiner*—Sherman D. Basinger
*Assistant Examiner*—Jesus D. Sotelo
*Attorney, Agent, or Firm*—Michael, Best & Friedrich

[57] ABSTRACT

Disclosed herein is a marine propulsion device comprising a transom bracket adapted to be connected to a boat transom, a tilt bracket having an upper end, a first pivot located behind the transom and connecting the tilt bracket to the transom bracket for pivotal movement of the tilt bracket relative to the transom bracket between a lower position and a full tilt position about a first pivot axis which is horizontal when the transom bracket is boat mounted, a trim bracket, a second pivot connecting the trim bracket to the tilt bracket below the first pivot for pivotal movement of the trim bracket relative to the tilt bracket between a lowermost position and a full trim position about a second pivot axis parallel to the first pivot axis, a propulsion unit including, at the lower end thereof, a rotatably mounted propeller, a third pivot connecting the propulsion unit to the trim bracket for steering movement of the propulsion unit relative to the trim bracket about a generally vertical axis and for common pivotal movement with the trim bracket in a vertical plane about the first and second horizontal axes, and a linkage system including a toggle linkage and an extensible link connected to the toggle linkage for sequentially pivotally displacing the trim bracket and connected propulsion unit upwardly about the second pivot axis and then upwardly about the first pivot axis.

9 Claims, 3 Drawing Figures

DUAL PIVOT OUTBOARD MOTOR WITH TRIM AND TILT TOGGLE LINKAGE

RELATED APPLICATIONS

Reference is hereby made to the following related applications, all of which are assigned to the assignee of this application and incorporated herein by reference:

Stevens application Ser. No. 159,480, filed June 16, 1980, and entitled OUTBOARD MOTOR WITH ELEVATED HORIZONTAL PIVOT AXIS Blanchard application Ser. No. 167,337, filed July 9, 1980, and entitled OUTBOARD MOTOR WITH DUAL TRIM AND TILT AXES Hall et al. application Ser. No. 173,159, filed July 28, 1980, and entitled OUTBOARD MOTOR WITH TILT LINKAGE INCLUDING PIVOT LINK Hall et al. application Ser. No. 173,158, filed July 28, 1980, and entitled MARINE PROPULSION DEVICE STEERING MECHANISM Hall et al. application Ser. No. 183,209, filed Sept. 2, 1980, and entitled HYDRAULIC SYSTEM FOR OUTBOARD MOTOR WITH SEQUENTIALLY OPERATING TILT AND TRIM MEANS Hall et al. application Ser. No. 173,160, filed July 28, 1980, and entitled OUTBOARD MOTOR WITH SEQUENTIALLY OPERATING TILT AND TRIM MEANS Hall et al. application Ser. No. 173,162, filed July 28, 1980, and entitled LATERAL SUPPORT ARRANGEMENT FOR OUTBOARD MOTOR WITH SEPARATE TILT AND TRIM AXIS

BACKGROUND OF THE INVENTION

The invention relates generally to marine propulsion devices and, more particularly, to outboard motors including propulsion units which are steerable in a horizontal plane and tiltable in a vertical plane.

The invention also relates to arrangements for power tilting of propulsion units between a lower normal running position in which the propeller is submerged in water, and a tilted or raised position in which the propeller is located for above water accessibility.

Various arrangements for power tilting and/or trimming of marine propulsion units are set forth in the following patents:

| | | |
|---|---|---|
| Carpenter | 3,722,455 | March 27, 1973 |
| Shimanckas | 3,847,108 | November 12, 1974 |
| Borst | 3,863,592 | February 4, 1975 |
| Borst | 3,885,517 | May 27, 1975 |
| Hall | 3,983,835 | October 5, 1975 |
| Hall | 4,064,824 | December 27, 1977 |
| Hall | 4,096,820 | June 27, 1978 |
| Pichl | 4,177,747 | December 11, 1979 |

SUMMARY OF THE INVENTION

The invention provides a marine propulsion device comprising transom bracket means adapted to be connected to a boat transom, a tilt bracket having an upper end, first pivot means connecting the tilt bracket to the transom bracket means for pivotal movement of the tilt bracket relative to the transom bracket means between a lower position and a full tilt position about a first pivot axis which is horizontal when the transom bracket means is boat mounted, a trim bracket, second pivot means connecting the trim bracket to the tilt bracket below the first pivot means for pivotal movement of the trim bracket relative to the tilt bracket between a lowermost position and a full trim position about a second pivot axis parallel to the first pivot axis, a propulsion unit including, at the lower end thereof, a rotatably mounted propeller, means connecting the propulsion unit to the trim bracket for steering movement of the propulsion unit relative to the trim bracket about a generally vertical axis and for common pivotal movement with the trim bracket in a vertical plane about the first and second horizontal axes, and means including a toggle linkage and an extensible link connected to the toggle linkage for sequentially upwardly pivotally displacing the trim bracket and connected propulsion unit about the second pivot axis and then about the first pivot axis.

In one embodiment in accordance with the invention, the toggle linkage comprises a first link having a first part pivotally connected to the tilt bracket and having a second part, and a second link having a first part pivotally connected to the second part of the first link and having a second part pivotally connected to the trim bracket, which first and second links extend at an angle to each other when the trim bracket is in the lowermost position and are arranged such that the distance from the pivotal connection between the first link and the tilt bracket to the pivotal connection between the second link and the trim bracket when the trim bracket is in the lowermost position is less than the distance when the trim bracket is in the full trim position.

In one embodiment in accordance with the invention, the pivotal displacement means further includes stop means for limiting increase in the distance in response to extension of the extensible member.

In one embodiment in accordance with the invention, the extensible link has one end pivotally connected to the transom bracket means, has a second end connected to the toggle linkage, and is operable, upon extension, to straighten the toggle linkage until engagement with the stop means so as thereby to displace the trim bracket from the lowermost position to the full trim position, and thereafter to tilt the tilt bracket about the first axis from the lower position to the full tilt position.

In one embodiment in accordance with the invention, the extensible link is a hydraulic cylinder piston assembly.

In one embodiment in accordance with the invention, the first pivot means is located rearwardly of the boat transom and the first and second pivot axes are spaced apart with the second pivot axis being located below the first pivot axis.

Other features and advantages of the embodiments of the invention will become known by reference to the following general description, claims and appended drawings.

IN THE DRAWINGS

Figure 3:
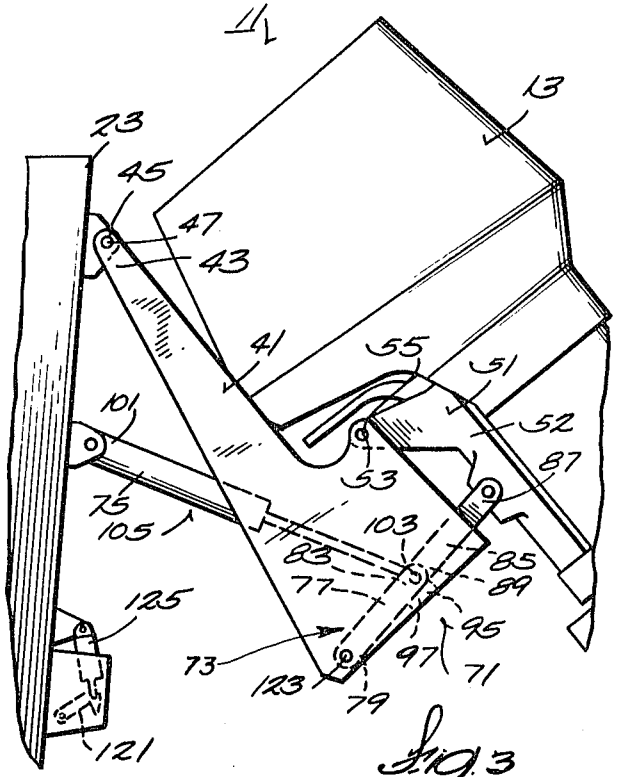
FIG. 3 is a fragmentary view similar to FIG. 1 illustrating the outboard motor in the full tilt position.

Before explaining one embodiment of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

Figure 1:
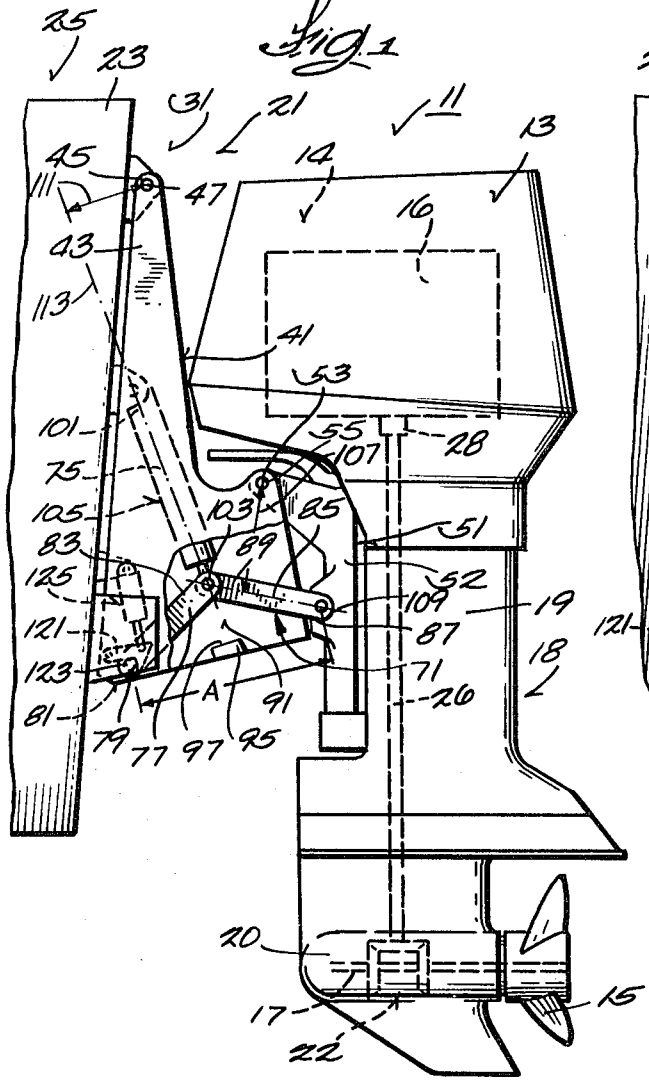
FIG. 1 is a side elevational view of one outboard motor incorporating various of the features of the invention and showing the outboard motor in the lowermost position.

Shown in FIG. 1 of the drawings is a marine propulsion device in the form of an outboard motor 11 having a generally conventional propulsion unit 13 including, at the lower end thereof, a rotatably mounted propeller 15 driven by a propeller shaft 17. The outboard motor 11 also includes means 21 for pivotally mounting the propulsion unit 13 for pivotal movement in both the horizontal and vertical planes relative to a transom 23 of a boat 25, whereby to provide for steering movement of the propulsion unit in the horizontal plane, and to provide for movement in the vertical plane of the propulsion unit 13 between a lowermost position with the propeller 15 fully submerged in water for driving propulsion and a raised or full tilt position affording above water accessibility to the propeller.

As is conventional, the propulsion unit 13 includes a powerhead 14 provided with an internal combustion engine 16, together with a lower unit 18 which is fixed to the bottom of the powerhead 14 and which includes a drive shaft housing 19 and a lower gear case or box 20 which supports the propeller shaft 17 carrying the propeller 15. The gear box 20 includes a suitable transmission 22 which connects the propeller shaft 17 to a drive shaft 26 which, in turn, is connected to the crankshaft 28 of the internal combustion engine 16.

The means 21 for pivotally mounting the propulsion unit 13 includes transom bracket means 31 which can be of unitary construction or which can comprise several parts, and which is adapted to be fixedly mounted on the transom 23 of the boat 25.

The means 21 for pivotally mounting the propulsion unit 13 also includes an intermediate or stern or tilt bracket 41 having an upper end 43, as well as first pivot means 45 located behind or aft of the boat transom 23 and connecting the upper end 43 of the stern or tilt bracket 41 to the transom bracket means 31 for pivotal movement of the stern or tilt bracket 41 about a first or upper pivot or tilt axis 47 which is horizontal when the transom bracket means 31 is boat mounted. Any means for effecting such pivotal connection can be employed. The tilt bracket is pivotally moveable between a lower position adjacent to the transom as shown in FIG. 1 and a full tilt or raised position or, as shown in FIG. 3.

The means 21 for pivotally mounting the propulsion unit 13 further comprises a swivel or trim bracket 51 including a vertical leg 52 together with second pivot means 53 connecting the swivel or trim bracket 51 to the stern or tilt bracket 41 at a point below the first pivot means 45 for pivotal movement of the swivel or trim bracket 51 relative to the stern or tilt bracket 41 about a second or lower pivot or trim axis 55 which is parallel to the first pivot or tilt axis 47. Any means for effecting such pivotal connection can be employed. The trim bracket is pivotally displaceable between a lowermost position shown in FIG. 1 and a full trim position shown in FIG. 2.

Figure 2:
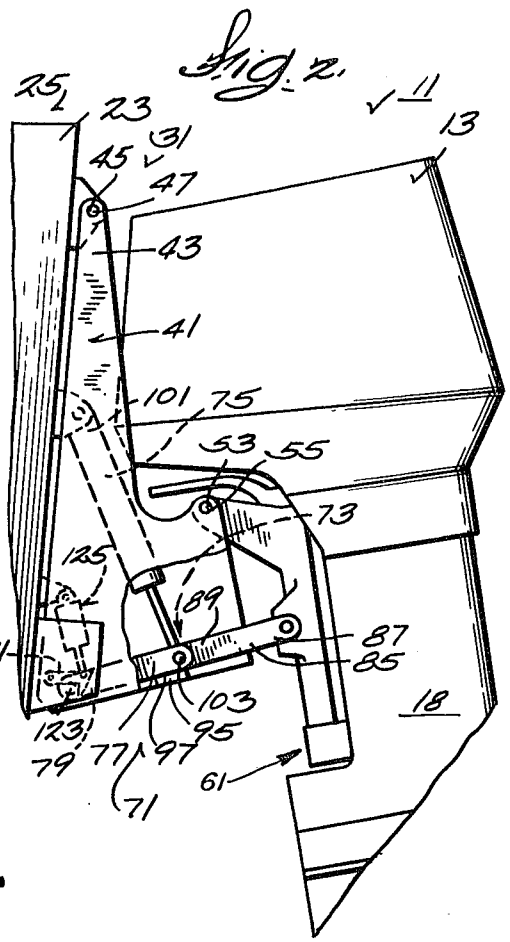
FIG. 2 is fragmentary view similar to FIG. 1 illustrating the outboard motor in the full trim position.

The means 21 for pivotally mounting the propulsion unit 13 further includes, see FIG. 2 means 61 for pivotally connecting the propulsion unit 13 to the trim or swivel bracket 51 for movement in common with the trim or swivel bracket 51 about the first and second or upper and lower or tilt and trim axes, 47 and 55 respectively, and for steering movement of the propulsion unit 13 about a generally vertical axis relative to the swivel or trim bracket 51. Any suitable means can be provided for pivotally connecting the swivel or trim bracket 51 and the propulsion unit 13 and any suitable means can be employed for effecting steering displacement in a horizontal plane of the propulsion unit 13 relative to the swivel bracket 51.

Means 71 including a toggle linkage 73 and an extensible link 75 are provided for pivotally displacing the propulsion unit 13 and, more specifically, for outwardly displacing the swivel or trim bracket 51 (together with the propulsion unit 13) relative to the stern or tilt bracket 41 through the trim range, i.e., from the lowermost position to the full trim position, and thereafter for outwardly displacing the tilt bracket (together with the trim bracket 51 and propulsion unit 13) through the tilt range, i.e., from the lower tilt bracket position to the full tilt or raised position.

The toggle linkage 73 includes a first link 77 having a first forward part or end 79 which is pivotally connected, by any suitable means, to the lower forward part 81 of the stern or tilt bracket 41. The first link 77 also includes a second or rearward end or part 83. In addition, the toggle linkage 73 includes a second link 85 having a first or rearward part or end 87 which is pivotally connected, by any suitable means, to the trim or swivel bracket 51 approximately midway of the vertical leg 52 thereof and having a second or forward part or end 89 which is pivotally connected, by any suitable means, to the second or rearward part or end 83 of the first link 77.

The first and second links 77 and 85 have lengths such that, when the trim or swivel bracket 51 is in its lowermost position, the links 77 and 85 extend at an angle 91 to each other and the distance A from the pivotal connection between the first link 77 and the tilt or stern bracket 41 to the pivotal connection between the second link 85 and the trim or swivel bracket 51 is less than the distance between these two connections when the trim bracket 51 is in the full trim position.

The means 71 for upwardly tilting the propulsion unit 13 also includes stop means 95 for limiting displacement of the first and second links 77 and 85 relatively to each other so as thereby to establish a maximum distance between the forward end 79 of the first link 77 and the rearward end 87 of the second link 85 and thereby also to define the full trim position of the trim bracket 51 relative to the tilt bracket 41. While various arrangements can be employed, in the illustrated construction, such means comprises an abutment 97 fixed on the tilt bracket 41 in position for engagement by the toggle linkage 73 when the angle 91 between the links 77 and 85 is approximately 180°. If desired, the first and second links 77 and 85 could be provided with interengageable means (not shown) to limit straightening thereof and/or interengagable means (not shown) could be provided between the extensible link 75 and one or more of the toggle links 77 and 85.

The extensible link 75 includes a forward or upper end or part 101 which is pivotally connected, by any suitable means, to the transom bracket means 31 and an opposed rearward or lower end or part 103 which is pivotally connected, by any suitable means, to the toggle linkage 73. While various arrangements can be employed, in the illustrated construction, the extensible link 75 comprises a suitable hydraulic cylinder-piston assembly 105 and the end 103 is connected to the pivotable connection between the first and second links 77 and 85. However, the end 103 could be connected to the first link 77 or to the second link 85 independently of the other of the links.

Any suitable means (not shown) can be employed to selectively supply pressure hydraulic fluid to the opposed ends of the cylinder of the cylinder-piston assembly 105 so as to extend and retract the cylinder-piston assembly 105.

In operation, initial extension of the cylinder-piston assembly 105 serves to displace or straighten the toggle linkage 73, thereby pivoting the trim or swivel bracket 51 (together with the propulsion unit 13) relative to the tilt or stern bracket 41 through the full trim range and until the toggle linkage 73 engages the abutment 97. Such movement takes place, at least in part, because the moment arm 107 from the lower trim axis 55 to a line 109 extending through the pivotal connections of the second link 85 is greater than the moment arm 111 from the upper tilt axis 47 to the axis 113 of the cylinder-piston assembly 105. Thus, initial movement of the propulsion unit 13 occurs as a result of pivotal displacement of the trim bracket 51 relative to the tilt bracket 41 through the full range between the lowermost position and the full trim position.

After engagement of the abutment 97 by the toggle linkage 73, further extension of the cylinder-piston assembly 105 causes upward pivotal movement of the tilt bracket 41 (together with the trim bracket 51 and the propulsion unit 13) about the upper or tilt axis 47.

Upon contraction of the cylinder-piston assembly 105, the tilt bracket 41 returns to its lower tilt position and thereafter the trim bracket 51 pivots relative to the tilt bracket 41 through the trim range to the lowermost position.

While only one toggle linkage 73 and one cylinder-piston assembly 105 have been shown it is to be understood that a second or more generally identically constructed and attached toggle linkages and/or extensible links or members could be employed.

If desired, a releasable reverse lock can be employed to interconnect the tilt bracket 41 and transom bracket means 31 to prevent upward movement of the tilt bracket 41 from its lower tilt position in response to rearward propulsion. Various arrangements can be employed, for instance, a hook 121 pivotally connected to the transom bracket means 31 can be engageable with a pivot or stud 123 which also serves to connect the first link 77 to the tilt bracket 41. Alternatively, the hook 121 could be engageable with a stud on the tilt bracket 41.

The hook 121 can be displaced between a position engaging or retaining the tilt bracket 41 and a position clear of engagement or retention with the tilt bracket 41 by any suitable means, such as, for instance, a selectively operable hydraulic cylinder-piston assembly 125 fixed to the transom bracket means 31 or by other manual means, or by spring loaded cam releasable means. Still further, cam means (not shown) on the first link 77 can be employed to control engagement of the hook 121 with the stern or tilt bracket 41 when the trim bracket 51 and propulsion unit 13 are in the trim range.

Various of the features of the invention are set forth in the following claims.

We claim:

1. A marine propulsion device comprising a transom bracket means adapted to be connected to a boat transom, a tilt bracket having an upper end, first pivot means connecting said tilt bracket to said transom bracket means for pivotal movement of said tilt bracket relative to said transom bracket means between a lower position and a full tilt position about a first pivot axis which is horizontal when said transom bracket means is boat mounted, a trim bracket, second pivot means connecting said trim bracket to said tilt bracket below said first pivot means for pivotal movement of said trim bracket relative to said tilt bracket between a lowermost position and a full trim position about a second pivot axis parallel to said first pivot axis, a propulsion unit including, at the lower end thereof, a rotatably mounted propeller, means connecting said propulsion unit to said trim bracket for steering movement of said propulsion unit relative to said trim bracket about a generally vertical axis and for common pivotal movement with said trim bracket in a vertical plane about said first and second horizontal axes, and means including a toggle linkage and an extensible link connected to said toggle linkage for sequentially upwardly pivotally displacing said trim bracket and connected propulsion unit about said second pivot axis and then about said first pivot axis.

2. A marine propulsion device in accordance with claim 1 wherein said toggle linkage comprises a first link having a first part pivotally connected to said tilt bracket and having a second part, a second link having a first part pivotally connected to said second part of said first link and having a second part pivotally connected to said trim bracket, said first and second links extending at an angle to each other when said trim bracket is in said lowermost position and being arranged such that the distance from the pivotal connection between said first link and said tilt bracket to the pivotal connection between said second link and said trim bracket when said trim bracket is in the lowermost position is less than said distance when said trim bracket is in the full trim position.

3. A marine propulsion device in accordance with claim 2 wherein said pivotal displacement means further includes stop means for limiting increase in said distance in response to extension of said extensible link.

4. A marine propulsion device in accordance with claim 3 wherein said extensible link has one end pivotally connected to said transom bracket means and has a second end connected to said toggle linkage and is operable, upon extension, to straighten said toggle linkage until engagement of said stop means so as thereby to displace said trim bracket from said lowermost position to said full trim position, and thereafter to tilt said tilt bracket about said first axis from said lower position to said full tilt position.

5. A marine propulsion device in accordance with claim 1 which said extensible link is a hydraulic cylinder piston assembly.

6. A marine propulsion device in accordance with claim 1 wherein said first pivot means is located rearwardly of the boat transom.

7. A marine propulsion device in accordance with claim 1 wherein said first and second pivot axes are spaced apart.

8. A marine propulsion device in accordance with claim 1 wherein said second pivot axis is located below said first pivot axis.

9. A marine propulsion device comprising transom bracket means adapted to be connected to a boat transom, a propulsion unit including a power head and having, at the lower end thereof, a rotatably mounted propeller, means connecting said propulsion unit to said transom bracket means for pivotal movement of said propulsion unit relative to said transom bracket means about a first axis which is horizontal when said transom bracket means is boat mounted, and between a lower position with said propeller submerged in the water and a full tilt position with said propeller substantially out of the water; and for steering movement of said propulsion unit relative to said transom bracket means about a second axis which is transverse to said first axis, and movement effecting means including a toggle linkage connected to said propulsion unit and an extensible link connected between said transom bracket means and said toggle linkage for pivotally displacing said propulsion unit about said first axis between said lower position with said propeller submerged in the water and said full tilt position with said propeller substantially out of the water.

* * * * *